United States Patent [19]

Borisof

[11] 4,273,537

[45] Jun. 16, 1981

[54] SELF-ADHERING EDUCATIONAL DEVICES FOR CONSTRUCTING LETTERS, FIGURES, DESIGNS AND THE LIKE

[76] Inventor: Bernard Borisof, 3920 N. Lake Shore Dr., Chicago, Ill. 60613

[21] Appl. No.: 774,706

[22] Filed: Mar. 4, 1977

Related U.S. Application Data

[63] Continuation of Ser. No. 605,239, Aug. 18, 1975, abandoned.

[51] Int. Cl.[3] ..... A63H 33/14

[52] U.S. Cl. ..... 434/83; 46/DIG. 1; 428/542

[58] Field of Search ..... 35/18 A, 26, 27, 28, 35/34, 71; 40/125 A; 46/23, 27, 29, DIG. 1; 52/DIG. 10; 273/95 R, 106.5 R, 106.5 A, DIG. 27; 428/375, 378, 395, 485

[56] References Cited

U.S. PATENT DOCUMENTS

| | | | |
|---|---|---|---|
| 2,148,632 | 2/1939 | Lovejoy | 35/26 |
| 2,888,365 | 5/1959 | Corkum | 428/485 X |
| 2,914,873 | 12/1959 | Brennan | 40/125 A |
| 3,044,917 | 7/1962 | Stout | 428/485 |
| 3,904,805 | 9/1975 | Johnson | 428/378 |

FOREIGN PATENT DOCUMENTS

| | | | |
|---|---|---|---|
| 729584 | 3/1966 | Canada | 428/378 |
| 1226575 | 2/1960 | France | 428/378 |
| 755543 | 8/1956 | United Kingdom | 428/378 |

*Primary Examiner*—Harland S. Skogquist

*Attorney, Agent, or Firm*—Burmeister, York, Palmatier, Hamby & Jones

[57] ABSTRACT

The disclosed educational devices comprise self-adhering members, to which a pressure sensitive adhesive material is applied, on the outside of at least a portion of each member. In one embodiment, each educational device comprises an elongated stick, rod or tube which is sufficiently rigid to be self-supporting. A knob or body of the adhesive material is mounted on at least one end of such stick or the like. Preferably, knobs of the adhesive material are mounted on both ends. The sticks may be adhered to one another and also to supporting surfaces, to produce letters, symbols, figures, geometric designs, and many types of artistic representations. In another embodiment, each educational device may comprise a flexible elongated member, such as a length of cord, yarn, wire or line, impregnated or coated with a pressure sensitive adhesive material in the form of microcrystalline wax with mineral oil in the proportion of 2 to 12% mixed with the wax to provide greater tackiness, the wax being of a flexible type with a melting point between 150° and 180° F. and a needle penetration between 20 and 50 when measured at 77° F. in accordance with ASTM Standard No. D1321.

16 Claims, 22 Drawing Figures

FIG. 11
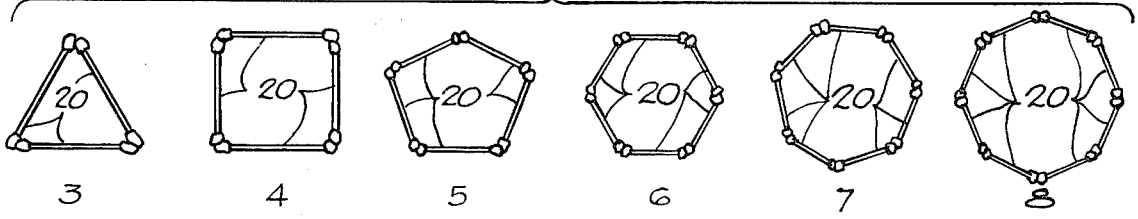
FIG. 12
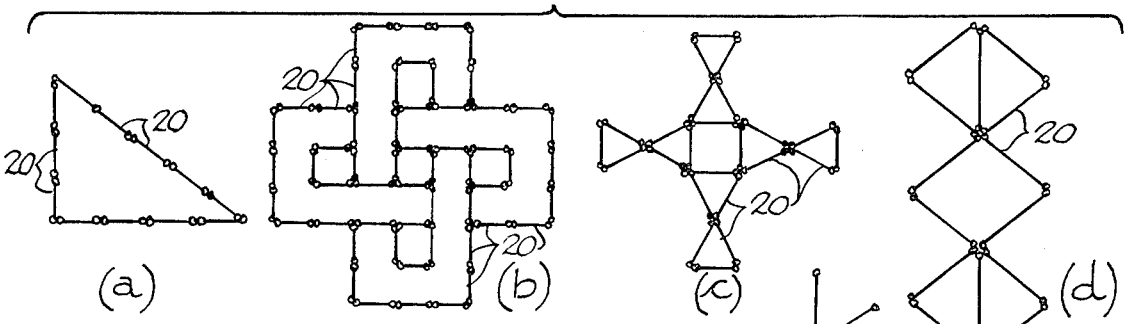
FIG. 15
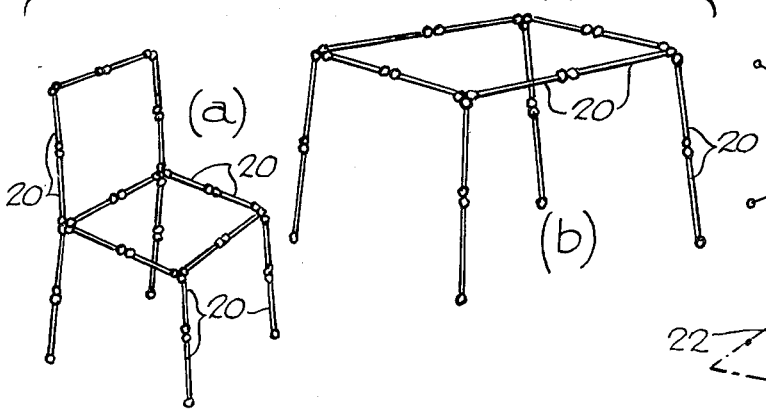
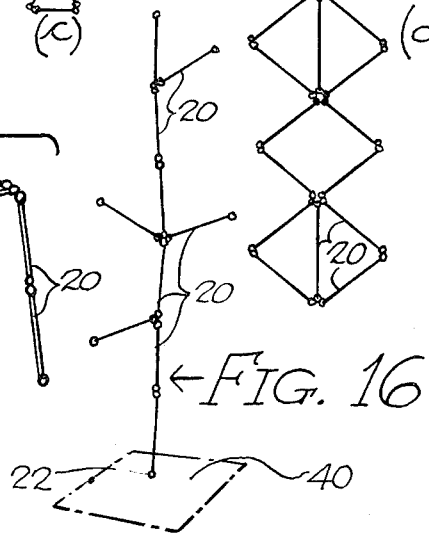
← FIG. 16
FIG. 13
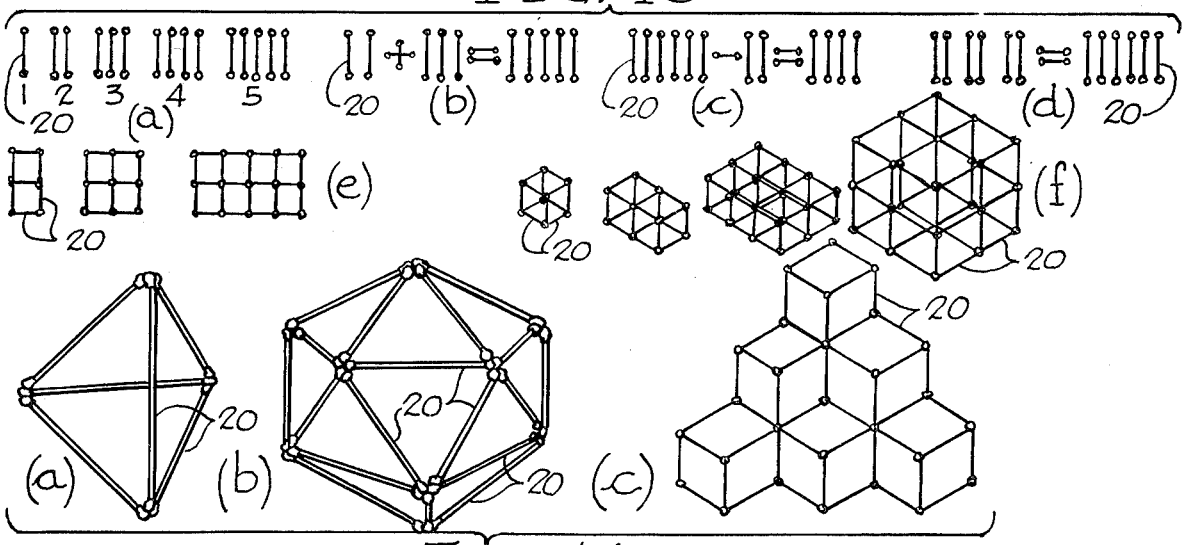
FIG. 14

SELF-ADHERING EDUCATIONAL DEVICES FOR CONSTRUCTING LETTERS, FIGURES, DESIGNS AND THE LIKE

This application is a continuation of my copending applicaton, Ser. No. 605,239, filed Aug. 18, 1975 and now abandoned.

This invention relates to educational devices which may be assembled or shaped to produce a wide variety of patterns, designs and representations, including letters, numbers, mathematical symbols, polygons, three-dimensional geometric figures, and an unlimited variety of artistic designs and representations.

One object of the present invention is to provide educational devices which are self-adhering, in that they cling to one another, and also to supporting surfaces. A further object is to provide such educational devices which can readily be disassembled and reused repeatedly, over a long useful life.

Another object is to provide such educational devices which may be assembled and disassembled very easily by young children, yet which are sufficiently challenging and fascinating to command the attention of persons of all ages.

The educational devices of the present invention provide handicraft and art materials which are particularly useful for young children in the primary grades, yet can be used by persons of all ages, ranging from preschool ages through primary, high school and college levels, to mature adults and senior citizens. The educational devices of the present invention enable even young children to exercise their intellectual and creative abilities, without being hindered by their normal lack of art skills and manual dexterity. The educational devices of this invention are particularly useful to assist in the teaching of such basic subjects as reading, writing and arithmetic.

Another object is to provide tangible handicraft and art materials which are especially useful for blind persons, in that the materials can be arranged, judged and rearranged through the sense of touch.

A further object is to provide an art material which will enable blind persons to use many colors in creating a picture, while also making it possible for blind persons to appreciate the gradations of color in the finished picture, all through the sense of touch.

In general, the educational devices of the present invention comprise elongated members which are either rigid or flexible, and are provided with pressure sensitive adhesive material on such members, so that the members will cling to one another, and also to supporting surfaces.

In one embodiment, the education devices comprise sticks, rods, tubes and other similar members which are sufficiently rigid to be self-supporting. A pressure sensitive adhesive material is applied to at least a portion of each rigid member. It is preferred to apply the pressure sensitive adhesive material in the form of a knob or body of the material, mounted on at least one end, and preferably on both ends of the rigid member. Various pressure sensitive adhesive materials may be employed, but microcrystalline wax is believed to be most suitable. The rigid sticks or other members may be assembled to produce self-supporting representations of letters, numbers, mathematical symbols, geometrical figures, designs, human and animal figures, and replicas of virtually any subject.

The educational devices may also comprise members other than sticks, to which a pressure sensitive adhesive material is applied. For example, the members may take the form of plates which are triangular, rectangular, or of various other shapes, with knobs of the pressure sensitive adhesive applied to the corners of the plates.

In another embodiment, the educational devices comprise flexible elongated members, which may be made of cord, twine, yarn, line, wire or the like. The flexible members are coated or impregnated with a pressure sensitive adhesive material, such as microcrystalline wax. The flexible, self-clinging cord or other material can readily be shaped into any desired design or representation, and pressed into adhering engagement with itself or with a supporting surface, made of paper, cardboard or other suitable material. In this way, even young children can produce representations of letters, numbers, human figures, animals, and a wide variety of other figures and designs. It is easy to revise any such representation by pulling the self-clinging material away from the supporting surface, reshaping the material, and pushing it back against the supporting surface.

In further embodiments, the sticks and cords may have various cross-sectional shapes, such as square, circular rectangular and triangular. Each shape may be used for a different color to enable blind persons to determine the color by the sense of touch. In addition, various shades of each color may be identified by marking the sticks and cords with ridges, grooves or Braille-like dots.

Further objects, advantages and features of the present invention will appear from the following description, taken with the accompanying drawings, in which:

FIG. 11 illustrates the production of polygons by the assembly of the devices of FIG. 1.

FIG. 12 illustrates various designs involving triangles and rectangles, produced by assembling the devices of FIG. 1.

FIG. 13 illustrates mathematical symbols and figures in one, two and three dimensions, produced by assembling the devices of FIG. 1.

FIG. 14 illustrates three-dimensional geometrical figures produced by assembling the devices of FIG. 1.

FIG. 15 illustrates representations of a chair and a table, produced by assembling the devices of FIG. 1.

FIG. 16 illustrates a free-standing figure produced by assembling the devices of FIG. 1.

Figure 19:
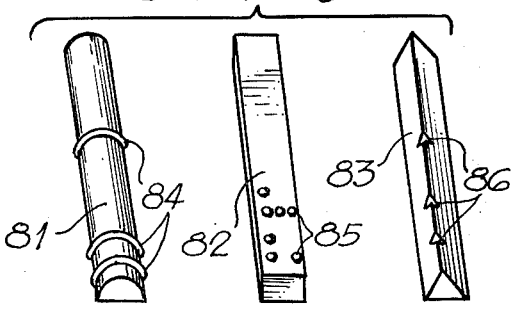
FIG. 19 illustrates a series of self-adhering members, in which different cross-sectional shapes represent different colors, and in which various shades of each color are identified by marking the members with ridges, grooves and Braille dots.
Figure 20:
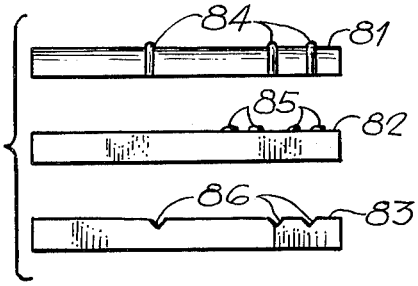

FIG. 20 comprises side elevational views of the self-adhering members shown in FIG. 19.

Figure 21:
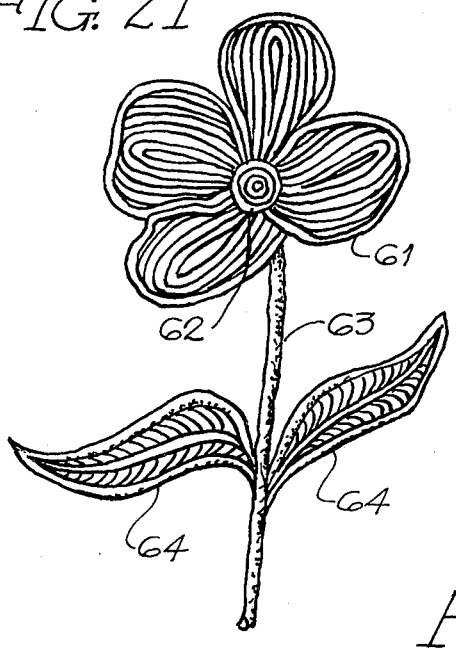
Figure 17:
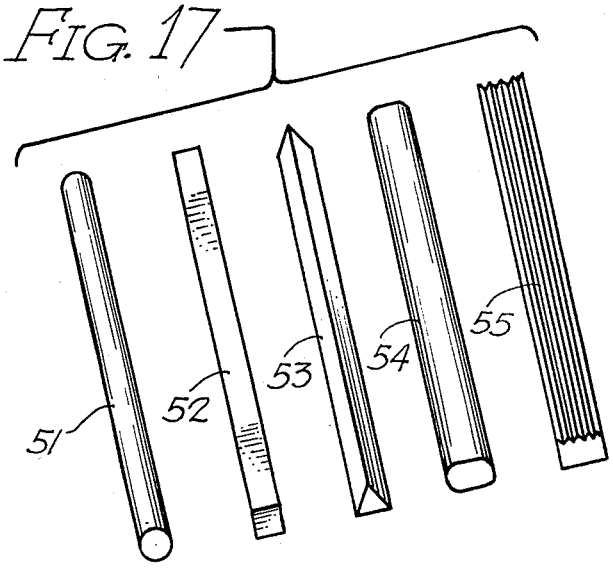
FIG. 17 illustrates a series of self-adhering members having various cross-sectional shapes, to represent different colors.
Figure 18:
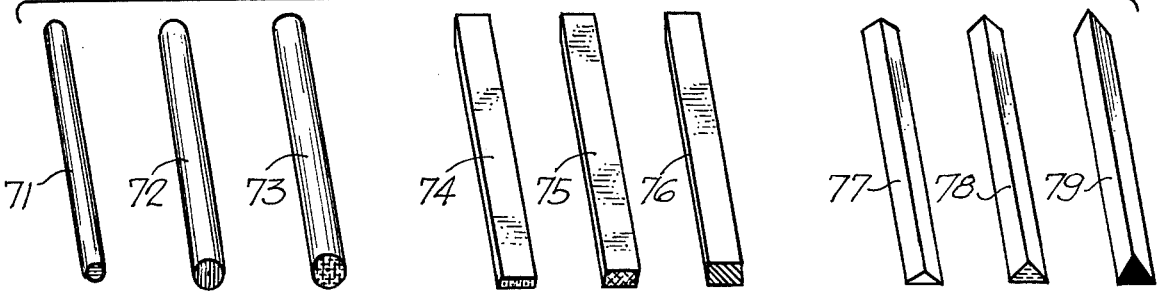
FIG. 18 illustrates a modified series of self-adhering members in which different colors are represented by different cross-sectional shapes, and also by different sizes of each shape.

FIG. 21 represents a picture of a colored flower which may be produced by assembling colored self-adhering members of the type shown in FIGS. 17, 18 and 19.

Figure 22:
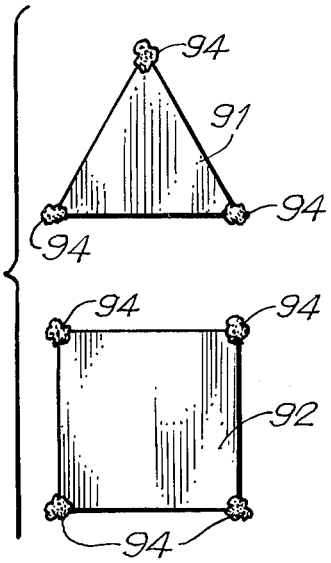

FIG. 22 illustrates modified self-adhering members in the form of triangular and rectangular plates which may be assembled to produce figures, models and the like.

Figure 1:
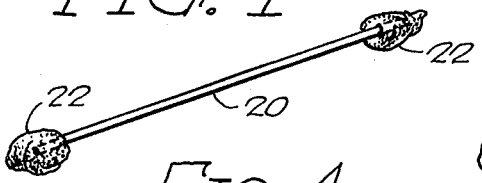
FIG. 1 is a perspective view of an educational device constituting one illustrative embodiment of the present invention, such embodiment being in the form of a rigid stick or other member, to which pressure sensitive adhesive material is applied.

As just indicated, FIG. 1 illustrates an educational device in the form of an elongated stick or member 20 which is sufficiently rigid to be self-supporting. The stick 20 may be made of any suitable material, such as wood, metal or a resinous plastic, for example.

In addition, the stick 20 may be in the form of a solid rod, a hollow tube, or any other suitable form.

A quantity of pressure sensitive adhesive material is applied to at least a portion of the stick 20 so that it will be self-adhering. It is preferred to employ the adhesive material in the form of a body or knob 22 of the adhesive material, mounted on at least one end of the stick 20, preferably on both ends, as illustrated in FIG. 1.

The stick 20 may be of any desired size. For example, it may be as small as a toothpick, or several times larger. In a preferred construction, the stick 20 takes the form of a cylindrical tube made of a resinous plastic material, preferably polypropylene. The knobs 22 of pressure sensitive adhesive material preferably are made of a microcrystalline wax. Preferably, the wax is of a malleable type, with a melting point between 150° and 180° F., and a needle penetration reading between 20 and 50 at 77° F., when subjected to the ASTM D1321 test. The tackiness of the wax is preferably increased by adding from 2 to 12% mineral oil, and 0 to 2% of low molecular weight polyethylene. This pressure sensitive adhesive material is stiff and strong enough to support a large structure, yet is readily molded to any desired shape, to hold many sticks at a single joint. In addition, this adhesive is stiff enough to hold two or more members in any desired relationship, or to hold a single member, or a series of members upright on a tabletop or other supporting surface, to stand along, without any support other than the adhesive. The adhesive material is perpetually pressure sensitive, so as to permit an unlimited amount of assembly, disassembly and reassembly of the sticks. The pressure sensitive adhesive material requires only fingertip pressure to cause the sticks to cling together, yet the material is not highly tacky to the touch and does not leave a stain when adhered to a tabletop or some other supporting surface. It will be evident that the malleability, melting point and needle penetration, referred to in this paragraph, relate to the wax, before the addition of any mineral oil or polyethylene.

The use of polypropylene tubes as the sticks 20 has the advantage that such tubes are strong and unbreakable. The tubes retain their straightness and form secure bonds with the wax adhesive. The addition, the polypropylene tubes retain a clean appearance after extensive handling.

The size of the tubes can be varied over a wide range. For example, the tubes may have an outside diameter of 0.085 of an inch, and an inside diameter of 0.025 of an inch. Any desired length may be employed, such as $2\frac{1}{2}$ inches.

The tubular polypropylene sticks can be bent severely without kinking and are light enough in weight to enable the adhesive material to hold complicated structures together. The adhesive knobs may be of any desired size, such as about $\frac{1}{4}$ of an inch in diameter.

Wood sticks are also highly suitable. For example, the sticks may be made of birch wood and may have a rectangular cross section, approximately 3/32 of an inch square and about $2\frac{1}{2}$ inches long. This size is large enough to provide for easy manipulation, yet small enough to permit elaborate construction on a tabletop or some other supporting surface.

Another suitable pressure sensitive adhesive may comprise a mixture of low molecular weight polyisobutylene and a polyterpene resin, having amelting point of about 70° C., with the addition of a quantity of inert finely divided filler material to make a tacky, mastic mix.

Another suitable adhesive consists of asphalt plus about 15% mineral oil. However, it is possible to employ any adhesive mixture which remains permanently pressure sensitive and is viscous enough to retain a thick shape.

Figure 2:
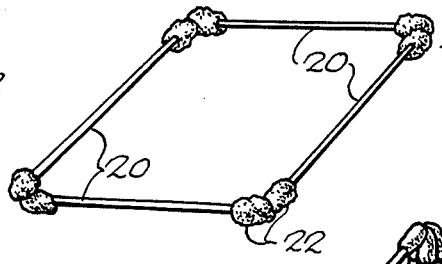
FIG. 2 is a prepresentation of a geometrical figure, produced by assembling educational devices of the construction illustrated in FIG. 1.

FIGS. 2–6 illustrate a variety of figures and designs which can be produced by assembling several self-adhering members of the type illustrated in FIG. 1. Thus, FIG. 2 illustrates a four sided geometrical figure, which may be either a square or a parallelogram, and may be produced by assembling four of the self-adhering sticks 20 of FIG. 1. The joints between the sticks 20 are formed by pressing the adhesive knobs 22 together. The geometrical figure is sufficiently rigid to be self-supporting and to retain its original shape, since the adhesive itself is viscous and rigid enough to retain such shape.

Figure 3:
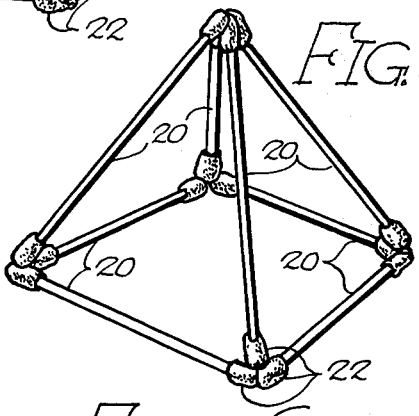
FIG. 3 illustrates a three-dimensional geometrical figure in the form of a pyramide, produced by assembling the devices of FIG. 1.

FIG. 3 illustrates a more elaborate three-dimensional geometrical figure in the form of a pyramid, which can be produced by assembling eight of the self-adhering sticks 20 of FIG. 1.

Figure 4:
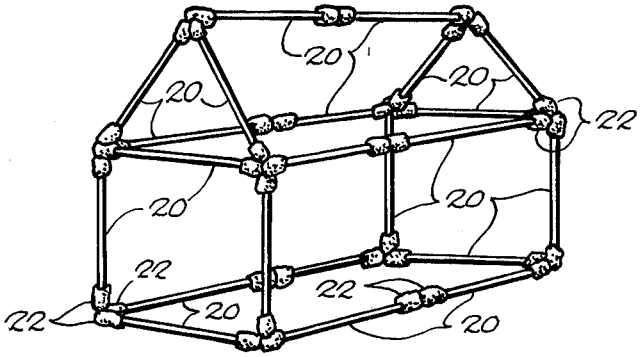
FIG. 4 illustrates a representation of a house or building, produced by assembling the devices of FIG. 1.

FIG. 4 illustrates a still more elaborate representation of a house or building, assembled from twenty-two of the self-adhering sticks 20 of FIG. 1.

Figure 5:
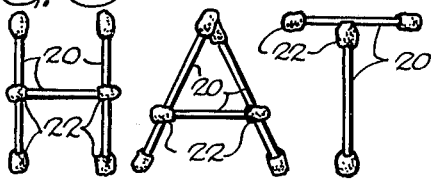
FIGS. 5 and 6 illustrate letters and words which are produced by assembling the devices of FIG. 1.
Figure 6:
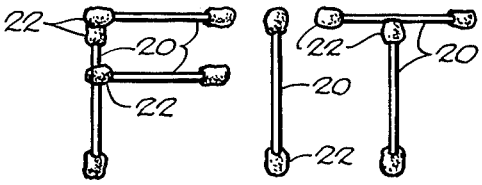

FIGS. 5 and 6 illustrate letters and words which can be produced by assembling the self-adhering sticks 20 of FIG. 1. Thus, FIG. 5 illustrates the word HAT, while FIG. 6 illustrates the word FIT. These representations show that the self-adhering educational devices of FIG. 1 are valuable in teaching young childred to read and write.

Figure 7:
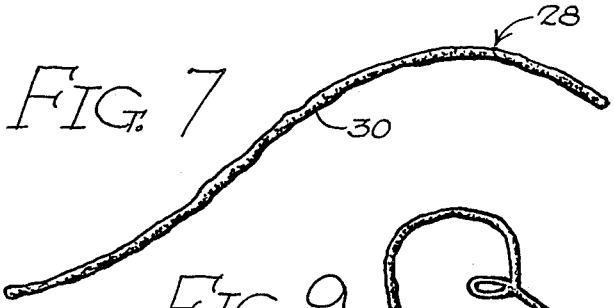
FIG. 7 illustrates another embodiment of the present invention, comprising a flexible cord or other member to which pressure sensitive adhesive is applied.

FIG. 7 illustrates an educational device 28, constituting another illustrative embodiment of the present invention. The educational device 28 comprises an elongated member 30 which is flexible in this case, and is coated or impregnated with a pressure sensitive adhesive material. The flexible elongated member 30 may be made of a wide variety of materials, but it is preferred to employ a polyester yarn, saturated with a pressure sensitive adhesive material in the form of microcrystalline wax. Yarns of various types may be employed. It is preferred, for example, to employ four ply yarn with an eights weight, which yields 1100 yards per pound. A line of this weight or heavier, impregnated with a suitable adhesive, such as microcrystalline wax, makes a cord which is self-supporting and can be used to make models which are free-standing. However, two and three ply yarns are also effective. Moreover, lighter and heavier weights may also be employed, according to the kind of line which is desired.

The microcrystalline wax is preferably of a flexible type, with a melting point between 150° and 180° F., and a needle penetration at 77° F. of 20 to 50, when measured in accordance with Standard No. D1321 of the American Society for Testing Materials (ASTM). Mineral oil in the proportion of 2 to 12% is preferably mixed with the wax to provide a greater tackiness. It will be evident that the flexibility, melting point and needle penetration, referred to in this paragraph, relate to the wax, before the addition of any mineral oil.

The yarn or line 30 may be supplied in a wide variety of colors. In this way, a wide range of artistic effects can be achieved by employing different colors.

Various other materials may be employed in the flexible line 30. For example, the line 30 may take the form of cotton twine or cord, dipped in a pressure sensitive adhesive, such as a highly tackified elastomer. The line or cord may also be made of a soft plastic material, such as polyvinyl chloride, coated with a pressure sensitive adhesive in the form of a plasticized resin. The line may also be made of flexible wire, with or without a coating or covering material. Various combinations of cord materials and adhesive materials may be employed.

The educational device 28 of FIG. 7 may be adhered to itself or to paper, cardboard or any other suitable supporting material. If desired, the device can be peeled from the paper and readhered in a different pattern or arrangement. Thus, the educational device can be reused as often as desired. The educational device may be considered to be a reusable line, similar to a pencil line, but of a tangible character, separate from and independent of the sheet of paper.

This tangible line may be placed on paper or the like to follow a preprinted outline, such as pictures or cartoons from a newspaper, coloring book, or any other similar printed matter having pictures or lessons. The tangible line has an advantage over pencils or crayons for use by young children, who are usually lacking in manual dexterity, in that errors can easily be corrected by lifting and moving the tangible line. Thus, awkward and messy erasing is not required, and the picture is never ruined. Children acquire confidence in trying to "draw" with the flexible educational device of this invention, so that creative effort is stimulated.

Figure 8:
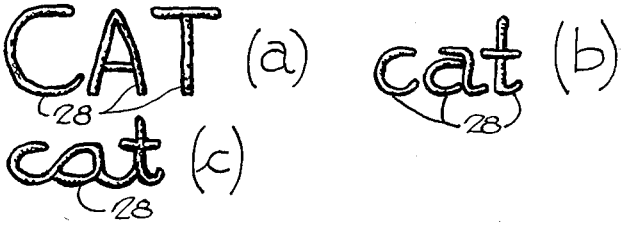
FIG. 8 illustrates representations of letters and words produced by shaping and assembling the devices of FIG. 7.

FIG. 8 illustrates the shaping and assembly of several lengths of the self-adhering cord 30, to produce letters and words. The self-adhering cord can be cut to various lengths with scissors and can then be shaped to form letters which are adhered to paper or any other supporting surface.

FIG. 8(a) shows the word CAT, represented in printed capital letters. FIG. 8(b) shows the word CAT, represented in lower case printed letters. FIG. 8(c) illustrates the word CAT, represented in script letters. Various colors may be employed for different letters or portions of letters.

As illustrated in FIG. 8, the tangible self-adhering lines of the present invention have important advantages for teaching reading and writing. The beginner in reading and writing is overwhelmed by a flood of symbols, including alphabets in capital letters, lower case letters and script. Additional confusion is caused by phonic variations. The present invention enlists the child's dominant sense of touch, so that the child can actually feel the shape of the letters. The combination of sight and touch improves the recognition of the letters. Furthermore, by forming letters with the tangible self-adhering lines of the present invention, the child has an easy tactile preparation for the immensely more difficult writing process. The tangible self-adhering lines of the present invention are also very helpful to blind and handicapped persons, for assistance in learning to write and in making graphic representations.

As will be discussed in greater detail in connection with FIGS. 17–21, the sticks and cords of the present invention can be made in a variety of cross-sectional shapes, each shape representing a different color, so that blind persons can identify the colors by the sense of touch. Thus, blind persons can produce colored art work. Various shades of the different colors can be identified by marking the self-adhering members of the present invention with ridges, grooves or Braille dots.

It requires only fingertip pressure to cause the educational device to cling to paper or some other surface, or to itself. With very little effort, the device can be peeled from the supporting surface. Due to the permanently tacky nature of the pressure sensitive adhesive, the device can be readhered repeatedly.

Thus, the tangible self-adhering line of the present invention is not as wasteful as conventional teaching materials, such as pencils, crayons and paste, because the tangible self-adhering line lasts indefinitely. The tangible self-adhering line is thus in the nature of a tool, rather than an expendable material. Nevertheless, the tangible self-adhering line is as simple and economical as such conventional teaching materials, while offering vastly greater facility for learning.

Figure 9:
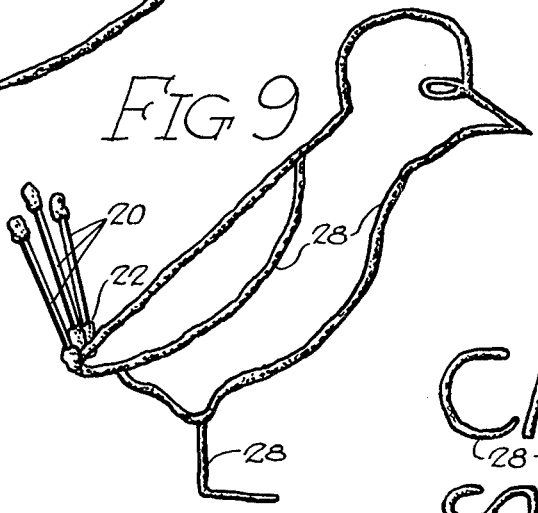
FIG. 9 shows a representation of a bird, produced by shaping and assembling devices of the kind illustrated in FIG. 7, in conjunction with the devices of the kind illustrated in FIG. 1.

FIG. 9 illustrates the manner in which the tangible self-adhering line 28 of FIG. 7 can be employed to produce pictures, models and other graphic representations. Thus, FIG. 9 comprises a picture of a bird which is produced by shaping the self-adhering line and pressing it against paper or some other supporting surface. Several pieces of the self-adhering line may be cut to the desired length for use in the picture. Pieces of line having different colors may be employed. A figure like that of FIG. 9 can also stand upright on a tabletop as a free-standing model which is self-supporting and will be kept from toppling by its adhesion to the tabletop.

FIG. 9 also illustrates the manner in which the flexible self-adhering line 28 of FIG. 7 may be employed in conjunction with the rigid self-adhering sticks 20 of FIG. 1. In the picture of FIG. 9, several of the self-adhering sticks 20 are employed to simulate the tail feathers of the bird, while the flexible self-adhering line 28 is employed to produce the outline and various detailed features of the bird. The colors of the self-adhering sticks 20 and the self-adhering line 28 may be selected to achieve various artistic effects.

Figure 10:
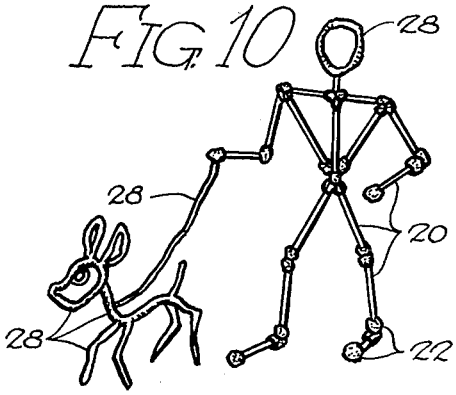
FIG. 10 illustrates a human figure and an animal figure, produced by assembling the devices of FIGS. 1 and 7.

FIG. 10 illustrates another representation which is produced by assembling the self-adhering sticks 20 in conjunction with the flexible self-adhering line 28. In this case, several of the self-adhering sticks 20 have been assembled to simulate a human figure. The head of the human figure is simulated by shaping a piece of the self-adhering line 28. The human figure is shown leading a dog, which is simulated by shaping and assembling various pieces of the self-adhering line 28. A leash is simulated by another piece of the self-adhering line 28.

FIG. 11 illustrates the advantageous manner in which the self-adhering sticks 20 of FIG. 1 can be employed in constructing geometric figures. Thus, FIG. 11 illustrates the production of a triangle, a square, a pentagon, a hexagon, a heptagon and an octagon by assembling the self-adhering sticks 20 in combinations of 3, 4, 5, 6, 7 and 8 sticks. The adhesive knobs 22 at the ends of the sticks are pressed together, so that they will adhere to each other, and the sticks are arranged to produce the regular polygons. It is much easier to produce polygons having 5, 6, 7 and 8 sides by the use of the self-adhering sticks 20, then it is to draw corresponding polygons with a pencil, paper and a ruler. The construction of the polygons with the use of the self-adhering sticks 20 is of great assistance to students in learning to visualize such geometric figures.

FIG. 12 illustrates the fact that a wide variety of complicated geometrical figures and fancy geometrical patterns can be constructed by assembling the self-adhering sticks 20 of FIG. 1. Thus, FIG. 12(a) illustrates the construction of a 3-4-5 triangle, using three sticks for one leg,four sticks for the other leg, and five sticks for the hypotenuse. This is a classic triangle of plane geometry.

FIG. 12(b) illustrates a fancy pattern of interlocking rectangles which is constructed by assembling a considerable number of the self-adhering sticks 20. By using sticks of various colors, interesting variations in the pattern can be produced.

FIG. 12(c) illustrates a complicated pattern involving squares and equilateral triangles which may be assembled by using a considerable number of the sticks 20, all of the same length.

FIG. 12(d) illustrates a pattern involving equilateral triangles and diamonds, requiring the assembly of numerous self-adhering sticks. Unlimited variety of patterns can be produced by assembling the self-adhering sticks, so that the sticks will serve as a means of education and amusement for children and adults of all ages.

FIG. 13 illustrates the manner in which the self-adhering sticks can be used to assist students in learning and understanding arithmetic and geometry. The self-adhering sticks of the present invention are particularly useful in teaching the concepts of quantity, arithmetic, area, volume and shape. In using the sticks to visualize the concepts of mathematics, the sticks may be stood on end on a tabletop, or some other supporting surface. The sticks will be held erect by the pressure sensitive adhesive. Groups of the sticks are easily set up, moved, and recombined to show quantity, addition, subtraction, multiplication and division.

The use of the self-adhering sticks is particularly advantageous in acquainting a young child with mathematical concepts, because the child's dominant sense of touch is employed and is reinforced by sight and sound, so as to provide a strong basis for comprehension of quantity and its mathematical manipulations. A young child finds it easy to manipulate the self-adhering sticks. In this way, the child is not subjected to the distractions and frustrations of awkward attempts at writing, during the learning process. Teaching by the visualization of concepts, rather than by rote is made possible.

Thus, FIG. 13(a) shows the arrangement of the self-adhering sticks into groups containing 1, 2, 3, 4 and 5 sticks. This grouping of the sticks helps the young student to understand the concept.

FIG. 13(b) shows the concept of simple addition, by the arrangement of the sticks into groups of 2, 3 and 5. By adhering the sticks flat on a tabletop, the plus sign and equal sign can readily be produced.

FIG. 13(c) illustrates the concept of simple subtraction, with the sticks arranged in groups of 6, 2 and 4. Here again, the self-adhering sticks can also be used to produce the minus sign and the equal sign.

FIG. 13(d) illustrates the concept of simple multiplication, by showing that three groups of two sticks are equivalent to one group of six sticks.

FIG. 13(e) illustrates how the self-adhering sticks can be arranged in groups of squares to illustrate the concept of area, and also the concepts of addition and multiplication of areas. As shown, the sticks are arranged in groups of 2, 4 and 6 squares. It immediately becomes apparent to the student that the addition of four squares to two existing squares produces six squares.

FIG. 13(f) shows the use of the self-adhering sticks to produce cubes, which are arranged in groups containing 1, 2, 6 and 8 cubes. Construction of such cubes is of great assistance in understanding the concept of volume.

FIG. 14 illustrates the fact that the self-adhering sticks 20 of FIG. 1 can be used very readily for the construction of three-dimensional shapes, geodesics and designs, which give the young student a vivid and tangible introduction to some of the basic concepts of solid geometry. Heretofore, the usual school materials such as paper, pencils and textbooks have tended to restrict children to a two-dimensional mental growth. The self-adhering sticks of the present invention gives students a means to develop three-dimensional thinking.

Thus, FIG. 14(a) illustrates the construction of a tetrahedron by assembling six of the self-adhering sticks. By the use of the self-adhering sticks, even young children can readily visualize this basic three-dimensional shape which is difficult to visualize otherwise. FIG. 14(b) shows the construction of a much more complicated icosahedron by assembling quite a number of the self-adhering sticks 20. This three-dimensional figure has 20 triangular sides. It will be apparent to the student that this figure is an interesting combination of triangles and pentagons.

FIG. 14(c) illustrates an interesting assembly of cubes in a stepped arrangement to produce an array of cube corners. Quite a number of the self-adhering sticks can be employed to construct this array.

FIG. 15 illustrates the manner in which the self-adhering sticks may be assembled to produce toys and the like. Thus, the self-adhering sticks can be employed as toy building elements. FIG. 15(a) illustrates the construction of a toy chair, while FIG. 15(b) shows the construction of a toy table. As previously indicated, FIG. 4 illustrates the construction of a toy house or building.

The self-adhering sticks of the present invention provide a high degree of versatility when used as toy building units. Conventional construction toys are limited in scope, but the self-adhering sticks do not suffer from such limitations. The self-adhering sticks can be used in much the same manner as lumber to produce a virtually unlimited variety of toy structures. Any number of sticks may be connected to one another at one point, and at any angle. If desired, the sticks can be cut to any desired length by the use of a pair of scissors. The knobs 22 of the pressure sensitive adhesive can be relocated to the cut ends of the sticks. If desired, the adhesive knobs can be subdivided and mounted on intermediate points on the sticks.

It will be understood that the self-adhering sticks of the present invention are as simple and inexpensive as conventional teaching materials, such as pencils, crayons, paper and paste, but are not as expendable, because the self-adhering sticks last indefinitely and afford a vastly greater facility for learning.

If desired, the pressure sensitive adhesive material may be applied as a relatively thin coating to the entire outer surface of the stick 20 of FIG. 1, or to any desired portion of such surface. The adhesive material may vary in consistency from a thin tacky coating to a relatively thick mastic, highly suitable for forming the adhesive knobs 22 of FIG. 1. The adhesive knob on the end of any particular stick can be employed for adhering the stick to any point along another stick, or to any other surface or member.

In referring to the relatively rigid self-adhering educational devices of FIG. 1, the word stick should be understood to include rigid members generally, such as rods, tubes and the like.

In referring to the relatively flexible self-adhering educational devices of FIG. 7, the word string or line should be understood to include other flexible members, such as cord, yarn, twine, wire, soft plastic members and the like.

The assembly of the educational devices of the present invention requires only a minimal amount of dexterity. Nevertheless, the assembly of such educational devices provides a valuable tactile exercise for the young child in preparation for learning to write, as well as for good hand-eye coordination.

It will be noted that both the relatively rigid self-adhering devices of FIG. 1 and the flexible self-adhering devices of FIG. 7 have considerable cross-sectional thickness so that they may be easily grasped and manipulated.

FIG. 16 illustrates a free-standing figure which can easily be produced by assembling the self-adhering sticks 20 of FIG. 1. The figure is supported by a single stick 20 which is adhered to a tabletop 40, or some other supporting surface. A series of additional sticks 20 can then be added to the first stick, to produce a wide variety of free-standing figures. The single knob 22 of pressure sensitive adhesive material adheres to the tabletop 40 with sufficient tenacity to afford the entire support for the free-standing figure, and to hold the figure in an upright position. The adhesive is sufficiently viscous and rigid to prevent the free-standing figure from toppling. It has been found that the previously mentioned microcrystalline wax provides all of these virtues in the pressure sensitive adhesive. Moreover, the adhesive can readily be removed from the supporting surface, and can be reused many times.

FIGS. 17–21 illustrate modified educational members which are especially valuable for use by blind persons, because such educational members make it possible for blind persons to create and enjoy multicolored art work. Thus, FIG. 17 illustrates a series of elongated educational members 51, 52, 53, 54, and 55 having different cross-sectional shapes. The members 51–55 are of different colors, which are correlated with the different shapes, so that each shape identifies a different color. Thus, blind persons can readily identify the colors of the educational members 51–55.

The educational members 51–55 of FIG. 17 may be either rigid or flexible. Thus, the members 51–55 may be in the form of rigid sticks, similar to those of FIG. 1. Alternatively, it is generally preferable to make the members 51–55 of a flexible material, such as a soft resinous plastic material. The user can then form the members 51–55 into any desired shape.

Preferably, the members 51–55 of FIG. 17 are caused to be self-adhering by applying a pressure sensitive adhesive to at least a portion of each member. Thus, each of the members 51–55 may be coated or impregnated with microcrystalline wax or some other suitable pressure sensitive adhesive, as in the case of the flexible member 28 of FIG. 7. Alternatively, the pressure sensitive adhesive can be applied to only limited portions of the members 51–55 of FIG. 17.

The colored members 51–55 of FIG. 17 can be used by either a blind person or a sighted person to produce a multicolored picture, such as the picture of a flower 60, shown in FIG. 21. The self-adhering members 51–55 are simply shaped and stuck to one another, or to a supporting surface, such as a sheet of paper. The flower 60 may have petals 61 of one color, such as red, a center 62 of another color, such as yellow, a stem 63 of a dark green or brown color, and leaves 64 of a lighter green color. After the picture has been completed, a blind person can identify the colors by the sense of touch, so that the blind person can enjoy the variety of colors.

Additional shades of color can be identified by the more elaborate system of FIG. 18. In this system, different cross-sectional sizes, as well as different cross-sectional shapes, are employed to identify various colors.

Thus, FIG. 18 illustrates three members 71, 72 and 73 which are round in cross-section and are of different cross-sectional sizes. The three primary colors may be assigned to these members of circular cross-section. Thus, the members 71, 72 and 73 may be colored blue, red and yellow, respectively.

FIG. 18 also illustrates three members 74, 75 and 76 which are rectangular in cross-section and are of different cross-sectional sizes. The three secondary colors may be assigned to these members of rectangular cross-section. For example, the members 74, 75 and 76 may be colored purple, orange and green, respectively. FIG. 18 also illustrates three members 77, 78, and 79 which are triangular in cross-section and are of different cross-sectional sizes. By way of further example, these members 77, 78 and 79 of triangular cross-section may be colored white, grey and black.

It will be evident from FIGS. 17 and 18 that a blind person will be able to identify a wide variety of colors by feeling the cross-sectional shape and size of the various members. As in the case of the members of FIG. 17, the members of FIG. 18 may be either rigid or flexible. When flexible members are desired, they are preferably made of a soft plastic material, such as polyethylene or polyvinylchloride, for example.

FIGS. 19 and 20 illustrate additional members 81, 82 and 83 which are of different cross-sections to indicate different colors. Thus, the illustrated members 81, 82 and 83 have cross-sections which are half round, rectangular and triangular, respectively. The three cross-sectional shapes may respresent any desired colors, such as blue, red and yellow, for example. Various shades of these basic colors may be represented by providing additional markings on the members. Such markings may take a variety of forms, including ridges 84, Braille dots 85 and notches 86, for example. The ridges, dots and notches may be arranged in a variety of patterns, so that a large number of color shades can be identified. The Braille dots 85 may represent different Braille numbers and letters. The markings 84, 85 and 86 of FIGS. 19 and 20 may be provided at regular intervals along the length of the members 81, 82 and 83. These markings will enable a blind person to identify and appreciate the colors of the members, so that the blind person will be able to use the members to produce elaborately colored pictures, patterns and models. The markings 84, 85 and 86 of FIGS. 19 and 20 may be formed integrally with the members 81, 82 and 83. Alternatively, the markings 84, 85 and 86 may be formed in a pressure sensitive adhesive coating which is applied to the members.

As previously indicated, the various construction members of FIGS. 17–20 are preferably rendered self-adhering by applying a suitable pressure sensitive adhesive to at least a portion of the outside of each member. The members can then be stuck to each other and to any suitable supporting surface. The adhesive may comprise a microcrystalline wax, for example.

The ridges 84, Braille dots 85 and notches 86 of FIGS. 19 and 20, and various other similar markings, may be used together in various combinations to identify a multitude of colors and shades of colors. If desired, the markings may be provided on one side of each construction member, while the pressure sensitive adhesive is applied to the other side.

The various construction members of FIGS. 17–20 may be employed to produce pictures similar to that of FIG. 21. In such pictures, the construction members may cover a large area or the entire area of the picture, rather than just the outlines of the subjects in the picture. Many colors may be employed. Since the construction members can be removed and rearranged easily, without the tedious erasing which is necessary when ordinary drawing materials are employed, the construction materials of the present invention have great appeal for persons with limited talent, while still affording great opportunities for creative development.

When the members of FIGS. 17–20 are to be adhered to a supporting surface, such as a sheet of paper, for example, the pressure sensitive adhesive may be applied to the supporting surface, if desired, rather than to the members. The concept of identifying the colors of the members by using different cross-sectional shapes, cross-sectional sizes and additional markings on the members is equally applicable, whether the pressure sensitive adhesive is applied to the members or to the supporting surface.

In FIGS. 1–21, the construction members are in the form of elongated sticks, rods, tubes, lines or the like. Other forms of self-adhering construction members may also be employed.

Thus, FIG. 22 illustrates modified construction members 91 and 92 which are in the form of flat plates or sheets of different shapes. Thus, the member 91 is triangular, while the member 92 is square or rectangular in shape. It is preferred to make the members 91 and 92 sufficiently thick to be relatively rigid. However, the members 91 and 92 may be in the form of thin sheets which are relatively flexible, if desired.

The plate-like members 91 and 92 of FIG. 22 may be made of various materials, such as resinous plastics, metal, wood, cardboard or paper, for example. Resinous plastics are especially suitable.

As before, a pressure sensitive adhesive material is preferably applied to at least a portion of each of the members 91 and 92 of FIG. 22. If desired, the adhesive may be applied in the form of a coating. However, in the construction illustrated in FIG. 22, the adhesive is in the form of small knobs or bodies 94, similar to the knobs 22 of FIG. 1. The adhesive knobs 94 are applied to the corners or extremities of the plate-like members 91 and 92. The composition of the adhesive material may be the same as discussed in connection with FIG. 1.

The plate-like members 91 and 92 of FIG. 22 may be used in much the same manner as the stick-like members 20 of FIG. 1. Thus, the members 91 and 92 may be stuck together, corner to corner, to form a wide variety of patterns and models. Moreover, free-standing, upright models may be constructed by pressing one of the adhesive knobs 94 against the supporting surface.

The plate-like members 91 and 92 of FIG. 22 may be combined with the stick-like members 20 of FIG. 1 to produce composite patterns, models and structures. The plate-like members 91 and 92 may also be combined with the various line or cord members of FIGS. 7 and 17–20. Thus, all of the illustrated members may be combined in a single design, model, structure or the like, if desired.

I claim:

1. A tangible line adapted to be shaped into free-standing models, said tangible line comprising a length of flexible cord, said cord being impregnated with a flexible pressure-sensitive adhesive wax material which is viscous enough to retain a thick shape and sufficiently rigid to make said cord self-supporting after being impregnated with said wax material, said wax material being malleable and having pressure-sensitive adhesive characteristics to make said tangible line self-adhering, said wax material being microcrystalline wax with mineral oil in the proportion of 2 to 12% mixed with said microcrystalline wax to provide greater tackiness, said microcrystalline wax being of a flexible type with a melting point between 150° and 180° F. and a needle penetration between 20 and 50 when measured at 77° F. in accordance with ASTM Standard No. D1321.

2. A tangible line according to claim 1, in which said cord is at least 4-ply polyester yarn of a weight at least as heavy as eights weight yielding 1100 yards per pound.

3. A tangible line according to claim 1, in which said flexible cord is string.

4. A tangible line according to claim 1, in which said flexible cord is polyester yarn.

5. A tangible line according to claim 1, in which said flexible cord is yarn.

6. An educational tool for teaching writing, said tool comprising a flexible self-adhering tangible line which can be shaped into letters of the alphabet and will cling to paper and other surfaces when pressed against such a surface with fingertip pressure while being easily lifted from the surface and moved to correct errors, said flexible self-adhering tangible line comprising a flexible cord, said flexible cord being saturated with flexible pressure-sensitive adhesive microcrystalline wax material, said cord when saturated with said wax material being flexible and readily shaped into letters of the alphabet, said wax material having peelable adhesive characteristics such that said tangible line is peelable from the surface with very little effort, said wax material being malleable and having a permanently, tacky nature to enable said tangible line to be readhered repeatedly, said wax material being viscous enough to retain a thick shape and not highly tacky to the touch, said wax material being microcrystalline wax with mineral oil in the proportion of 2 to 12% mixed with said microcrystalline wax to provide greater tackiness, said microcrystalline wax having a melting point between 150° and 180° F. and a needle penetration between 20 and 50 when measured at 77° F. in accordance with ASTM Standard D1321.

7. An educational tool according to claim 6, in which said flexible cord is polyester yarn.

8. An educational tool according to claim 6, in which said flexible cord is string.

9. An educational device, comprising a length of flexible yarn saturated with a flexible malleable pressure-sensitive adhesive microcrystalline wax material, said wax material being microcrystalline wax with mineral oil in the proportion of 2 to 12% mixed with said microcrystalline wax to provide greater tackiness, said microcrystalline wax having a melting point between 150° to 180° F. and a needle penetration between 20 and 50 when measured at 77° F. in accordance with ASTM Standard D1321.

10. A tangible line adapted to be shaped into free-standing models, said tangible line comprising a length of flexible cord, said cord being at least 4-ply yarn of a weight at least as heavy as eights weight yielding 1100 yards per pound, said cord being impregnated with a flexible pressure-sensitive adhesive wax material which is viscous enought to retain a thick shape and sufficiently rigid to make said tangible line self-supporting after said cord is impregnated with said wax material, said wax material being malleable and having pressure-sensitive adhesive characteristics to make said tangible line self-adhering, said wax material being microcrystalline wax with mineral oil in the proportion of 2 to 12% mixed with said microcrystalline wax to provide greater tackiness, said microcrystalline wax being of a flexible type with a melting point between 150° and 180° F. and a needle penetration between 20 and 50 when measured at 77° F. in accordance with ASTM Standard No. D1321.

11. A tangible line adapted to be shaped into free-standing models, said tangible line comprising a length of flexible yarn having at least 2 plies, said yarn being impregnated with a flexible pressure-sensitive adhesive wax material which is viscous enough to retain a thick shape and sufficiently rigid to make said flexible yarn self-supporting after being impregnated with said wax material, said wax material being malleable and having pressure-sensitive adhesive characteristics to make said tangible line self-adhering, said wax material being microcrystalline wax with mineral oil in the proportion of 2 to 12% mixed with said microcrystalline wax to provide greater tackiness, said microcrystalline wax being of a flexible type with a melting point between 150° and 180° F. and a needle penetration between 20 and 50 when measured at 77° F. in accordance with ASTM Standard No. D1321.

12. An educational tool for teaching writing, said tool comprising a flexible self-adhering tangible line which can be shaped into letters of the alphabet and will cling to paper and other surfaces when pressure against such a surface with fingertip pressure while being easily lifted from the surface and moved to correct errors, said flexible self-adhering tangible line comprising a flexible cord, said flexible cord being saturated with flexible pressure-sensitive adhesive microcrystalline wax material, said cord when saturated with said wax material being flexible and readily shaped into letters of the alphabet, said wax material having peelable adhesive characteristics such that said tangible line is peelable from the surface with very little effort, said wax material being malleable and having a permanently tacky nature to enable said tangible line to be readhered repeatedly, said wax material being viscous enough to retain a thick shape and not highly tacky to the touch, said wax material being microcrystalline wax with mineral oil in the proportion of 2 to 12% mixed with said microcrystalline wax to provide greater tackiness, said microcrystalline wax having a melting point between 150° and 180° F. and a needle penetration between 20 and 50 when measured at 77° F. in accordance with ASTM Standard D1321, said flexible cord being yarn having at least 2 plies.

13. An educational device, comprising a length of flexible yarn having at least 2 plies and saturated with a flexible malleable pressure-sensitive adhesive microcrystalline wax material, said wax material being microcrystalline wax with mineral oil in the proportion of 2 to 12% mixed with said microcrystalline wax to provide greater tackiness, said microcrystalline wax having a melting point between 150° and 180° F. and a needle penetration between 20 and 50 when measured at 77° F. in accordance with ASTM Standard D1321.

14. A tangible line adapted to be shaped into free-standing models, said tangible line comprising a length of flexible cord, said cord being impregnated with a flexible pressure-sensitive adhesive wax material which is viscous enough to retain a thick shape and sufficiently rigid to make said cord self-supporting after being impregnated with said wax material, said wax material having peelable adhesive characteristics such that said tangible line is peelable from a surface with very little effort and is not highly tacky to the touch, said wax material being malleable and having a permanently tacky nature to enable said tangible line to be readhered repeatedly, said wax material being microcrystalline wax with mineral oil in the proportion of 2 to 12% mixed with said microcrystalline wax to provide greater tackiness, said microcrystalline wax being of a flexible type with a melting point between 150° and 180° F. and a needle penetration between 20 and 50 when measured at 77° F. in accordance with ASTM Standard No. D1321.

15. A tangible line adapted to be shaped into free-standing models, said tangible line comprising a length of flexible cord, said flexible cord being yarn having at least 2 plies, said cord being impregnated with a flexible pressure-sensitive adhesive wax material which is viscous enough to retain a thick shape and sufficiently rigid to make said cord self-supporting after being impregnated with said wax material, said wax material having peelable adhesive characteristics such that said tangible line is peelable from a surface with very little effort and not highly tacky to the touch, said wax material being malleable and having a permanently tacky nature to enable said tangible line to be readhered repeatedly, said wax material being microcrystalline wax with mineral oil in the proportion of 2 to 12% mixed with said microcrystalline wax to provide greater tackiness.

said microcrystalline wax being of a flexible type with a melting point between 150° and 180° F. and a needle penetration between 20 and 50 when measured at 77° F. in accordance with ASTM Standard No. D1321.

16. A tangible line adapted to be shaped into free-standing models, said tangible line comprising a length of flexible cord, said flexible cord being at least 4-ply yarn of a weight at least as heavy as eights weight yielding 1100 yards per pound, said cord being impregnated with a flexible pressure-sensitive adhesive wax material which is viscous enough to retain a thick shape and sufficiently rigid to make said cord self-supporting after being impregnated with said wax material, said wax material having peelable adhesive characteristics such that said tangible line is peelable from a surface with very little effort and not highly tacky to the touch, said wax material being malleable and having a permanently tacky nature to enable said tangible line to be readhered repeatedly, said wax material being microcrystalline wax with mineral oil in the proportion of 2 to 12% mixed with said microcrystalline wax to provide greater tackiness, said microcrystalline wax being of a flexible type with a melting point between 150° and 180° F. and a needle penetration between 20 and 50 when measured at 77° F. in accordance with ASTM Standard No. D1321.

* * * * *